US005191164A

United States Patent [19]

Hawke et al.

[11] Patent Number: 5,191,164

[45] Date of Patent: Mar. 2, 1993

[54] HYBRID ARMATURE PROJECTILE

[75] Inventors: Ronald S. Hawke, Livermore, Calif.; James R. Asay, Los Lunas, N. Mex.; Clint A. Hall; Carl H. Konrad, both of Albuquerque, N. Mex.; Gerald L. Sauve, Berthoud, Colo.; Mohsen Shahinpoor, Albuquerque, N. Mex.; Allan R. Susoeff, Pleasanton, Calif.

[73] Assignee: The United States of America as represented by the Department of Energy, Washington, D.C.

[21] Appl. No.: 678,430

[22] Filed: Apr. 1, 1991

[51] Int. Cl.[5] ..... F41B 6/00

[52] U.S. Cl. ..... 89/8; 102/527

[58] Field of Search ..... 89/8; 102/524, 526, 102/527

[56] References Cited

U.S. PATENT DOCUMENTS

| | | | |
|---|---|---|---|
| H198 | 1/1987 | Stone | 102/524 |
| H237 | 3/1987 | Levy | 89/8 |
| 4,423,662 | 1/1984 | McAllister | 89/8 |
| 4,429,613 | 2/1984 | Deis et al. | 89/8 |
| 4,467,696 | 8/1984 | McNab et al. | 89/8 |
| 4,485,720 | 12/1984 | Kemeny | 89/8 |
| 4,706,542 | 11/1987 | Hawke | 89/8 |
| 4,733,595 | 3/1988 | Oberly | 89/8 |
| 4,858,511 | 8/1989 | Jasper, Jr. | 89/8 |

OTHER PUBLICATIONS

Winterberg, F., "The Electromagnetic Rocket Gun–A Novel Launch Concept", IEEE Transactions on Magnetics, vol. MAG-20, No. 2, Mar. 1984, pp. 370–372.

Usuba et al, "Railgun Experiment at Tokoyo Institute of Technology", IEEE Transactions on Magnetics, vol. MAG-22, No. 6, Nov. 1986, pp. 1790–1792.

Armature Option for Hypervelocity Railguns, IEEE Transactions on Magnetics, vol. 25, No. 1, pp. 552–557, Jan. 89.

Plasma Armature Formation in High-Pressure, High--Velocity Hydrogen, IEEE Transactions on Magnetics, vol. 25, No. 1, pp. 219–222.

Use of a Two-Stage Light-Gas Gun as an Injector for Electromagnetic Railguns, IEEE Transactions on Magnetics, vol. 25, pp. 514–518.

Railgun Performance with a Two-Stage Light-Gas Injector, IEEE Transactions on Magnetics, vol. 27, No. 1 pp. 28–32.

*Primary Examiner*—Stephen C. Bentley

*Attorney, Agent, or Firm*—Henry P. Sartorio; Roger S. Gaither; William R. Moser

[57] ABSTRACT

A projectile for a railgun that uses a hybrid armature and provides a seed block around part of the outer surface of the projectile to seed the hybrid plasma brush. In addition, the hybrid armature is continuously vaporized to replenish plasma in a plasma armature to provide a tandem armature and provides a unique ridge and groove to reduce plasama blowby.

35 Claims, 3 Drawing Sheets

HYBRID ARMATURE PROJECTILE

The United States Government has rights in this invention pursuant to Contract No. W-7405-ENG-48 and Contrast No. DE-AC04-76DP00789 awarded by the U.S. Department of Energy.

FIELD OF THE INVENTION

The invention relates to the area of railguns. Railgun accelerators have potential to accelerate projectiles to very high velocities in very short distances. The railgun accelerator is essentially a DC motor consisting of a first rail and a second rail, so that the rails form a pair of rigid parallel conductors that carry current to and from an interconnecting movable conductor. The movable conductor functions as an armature and the parallel rails serve as a single turn field winding. The resulting Lorentz force on the armature is proportional to the square of the current. The current creates a magnetic field which pushes the movable conductor forming a projectile along the rails in the forward direction. The rails are placed as interiors of a barrel to cause the projectile to accelerate through the bore of the barrel. The part of the barrel through which the projectile enters the bore is called the breech. Potential applications of railguns include 1) equation of state research of matter at high pressure and high energy density, 2) space and orbital launching from the earth, other planetary surfaces, and space platforms, 3) fusion energy production by injecting fuel pellets into a magnetic fusion reactor, and 4) strategic and tactical weapons. "Armature Options For Hypervelocity Railguns", IEEE Transactions On Magnetics Vol. 25, No. 1, pps 552–557, January 1989, by L. Thornhill, J. Batteh, and J. Brown describes four different types of armatures for railgun projectiles for establishing a current path between the first rail and the second rail and the advantages and disadvantages of each type.

A first type of armature is a solid piece of metal that extends from the first rail to the second rail. Some of the advantages are that the armature provides a low electrical resistance, a simple design, internally dissipated ohmic heat, and the elimination of ablation drag. Some of the disadvantages are that the contact friction limits solid to solid contacts to velocities of about 1–2 km/s and the high mass of the armature needed to dissipate the ohmic heat and thus prevent melting also makes the armature heavy causing a loss in efficiency.

A second type of armature is a plasma armature. This type of armature is generated by either exploding a metal foil behind the projectile or by directing a plasma discharge against the back of the projectile. In a purely plasma armature, there is no solid metal through which the current passes. Some of the advantages of a plasma armature are the low mass of the armature, good electrical contact at high velocities, and the elimination of issues concerning armature structural integrity. Some of the disadvantages of a plasma armature are the high electrical resistance of the plasma, susceptibility to ablation drag, the plasma instability limiting performance, viscous drag between the plasma and the bore wall, plasma loss by viscous drag, susceptibility to formation of a secondary arc, and plasma blowby. Ablation drag refers to the loss in acceleration arising from the ablation of the bore material and its subsequent entrainment into the plasma armature.

A third type of armature is a hybrid armature. A hybrid armature is a solid armature with gaps between each end of the solid armature and the rails. Plasmas are generated in the gap between the solid armature and the rails, becoming plasma brushes to conduct current from the rails to the solid armature. The advantage of the hybrid armature relative to a solid armature is that it reduces friction between the solid armature and the rails extending the use of these armatures past the 1–2 km/s solid armature limit. One of the problems with the use of the hybrid armature relative to the plasma armature is the high mass. However, the potential advantages of a hybrid armature in relation to a plasma armature include reducing energy loss, plasma instability, ablation and bore damage, susceptibility to secondary arc formation, and blowby.

A fourth type of armature is a transitioning armature. A transitioning armature begins as a solid armature at low speeds and transitions to a hybrid or pure plasma armature at high speeds due to the loss of solid to solid contact between the armature and the rails. Advantages of a solid to hybrid transitioning armature is that it minimizes plasma damage to the rails in the low velocity portion of the barrel near the breech, while providing higher efficiency than a pure plasma armature at higher velocities. The ablation caused by a pure plasma armature damages the bore. By having a solid armature where the projectile is slowest, damage to the bore is minimized. One of the disadvantages of a solid or hybrid armature are that the armature has a large parasitic mass. Disadvantages of plasma armatures are the possibility of plasma instability, barrel damage and ablation drag, susceptibility to secondary arc formation, plasma loss by viscous drag, and plasma blowby.

"Plasma Armature Formation In High-Pressure, High-Velocity Hydrogen", IEEE Transactions On Magnetics Vol. 25, No. 1, pps 219–222, January 1989, by R. S. Hawke, A. R. Susoeff, J. R. Asay, C. A. Hall, C. H. Konrad, R. J. Hickman, and J. L. Sauve describes the use of a two stage light-gas gun as a pre-accelerator in combination with a railgun which uses a pure plasma armature. The two stage light-gas gun used a hydrogen gas gun to accelerate the projectile to 6 km/s before the projectile enters the breech of a railgun. An aluminum or lithium foil or wire acts as a fuse to establish a pure plasma armature. The high velocity at which the projectile enters the breech reduces the duration of barrel exposure to the hot plasma, and thereby reduces ablation by the pure plasma armature and reduces melting of the rails at the breech. In the case of a hydrogen plasma the lowest possible viscous drag force is experienced. The neutral hydrogen gas following the metal and/or ionized hydrogen plasma prevents restrike. Problems in the two stage light-gas gun are that blowby, ablation drag and other factors reduce the efficiency of the pure plasma armature. Two stage gas guns used as injectors for railguns are further described in U.S. Pat. No. 4,706,542 by Ronald S. Hawke, and incorporated by reference.

SUMMARY OF THE INVENTION

It is an object of the invention to provide a projectile with an armature the reduces plasma instability.

It is another object of the invention to provide a means for maintaining plasma brushes for a hybrid armature.

It is another object of the invention to maintain a plasma in a plasma armature.

It is another object of the invention to reduce plasma blowby.

It is another object of the invention to reduce ablation drag.

It is another object of the invention to provide a railgun that produces a hypervelocity projectile.

It is another object of the invention to provide a railgun with reduced barrel damage.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The invention comprises an outer coating on the projectile which provides conductive particles for seeding plasma brushes, a solid armature utilizing the plasma brushes to form a hybrid armature, a sufficient current to continuously vaporize the solid armature to establish a plasma armature causing a tandem (hybrid/plasma) armature, and angled baffles to minimize blowby.

DETAILED DESCRIPTION OF THE EMBODIMENTS

Figure 1:
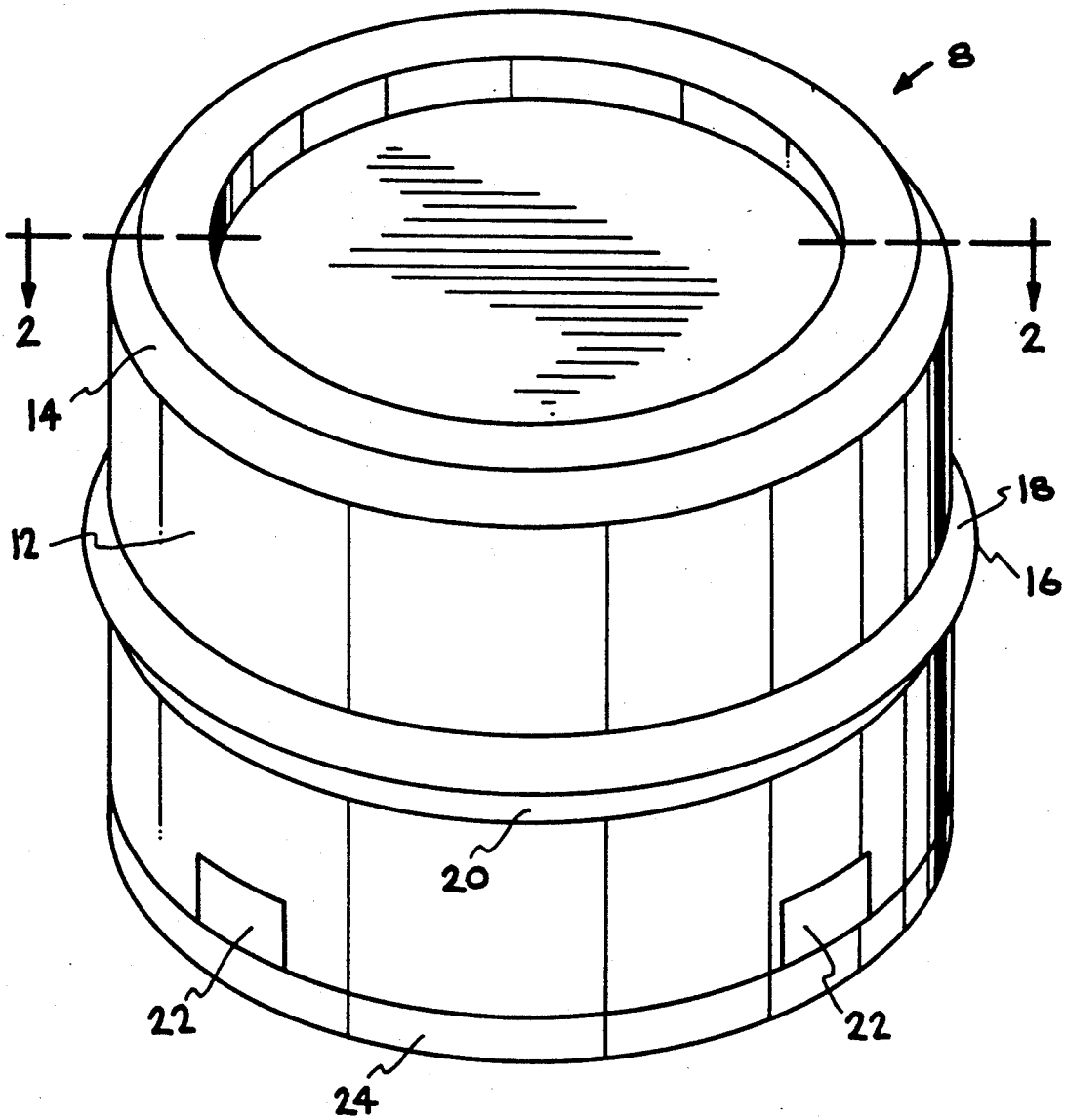
FIG. 1 is a perspective view of a projectile used in a two stage light-gas gun.
Figure 2:
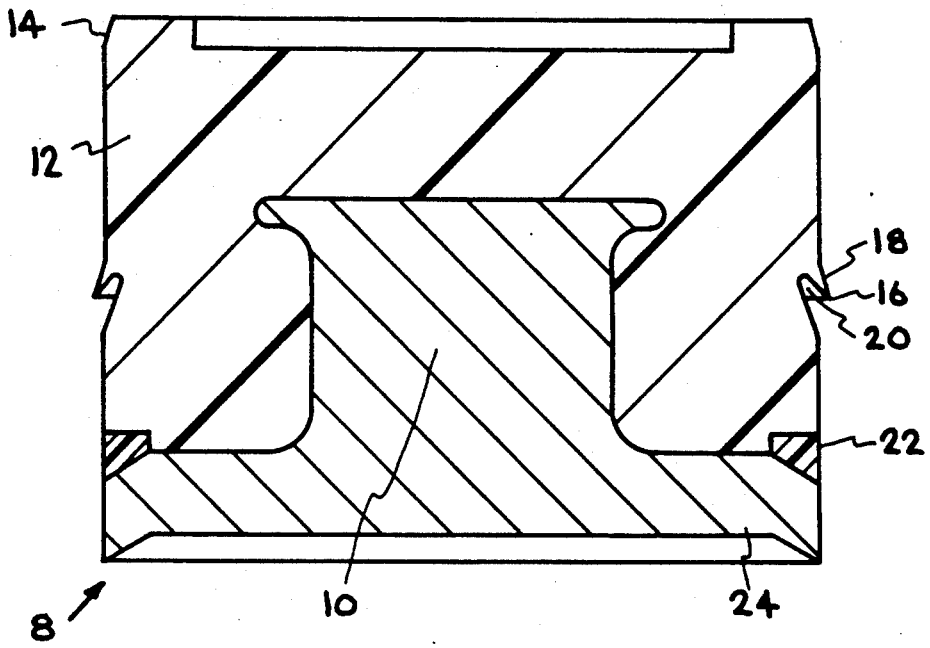
FIG. 2 is a cross-sectional view of the projectile in FIG. 1 along cut-lines II—II.

FIG. 1 is a perspective view of a preferred embodiment of the invention forming a projectile 8 used in a two stage light-gas gun. FIG. 2 is a cross-sectional view of the projectile in FIG. 1 along cut-lines II—II. The projectile 8 comprises an aluminum core 10 with a cylindrical LEXAN body 12 molded around the aluminum core 10. LEXAN is polycarbonate, an electrically insulative material, manufactured by General Electric Co. The front end outer surface of the body 12 has a slight bevel 14, so that the cylindrical body 12 gas a diminishing diameter in that area. On the outer surface of the body 12 between the front end and the back end of the projectile is a ridge 16. The ridge is formed by a section 18 of the body 12, wherein the section 18 increases in diameter going from the front end of the projectile 8 to the back end of the projectile 8, and a groove 20 in the body 12. Seed blocks 22 are placed along the outer surface of the back end of the LEXAN body. In the preferred embodiment the seed blocks 22 are made of plastic with particles of silver embedded within. The aluminum core 10 extends into the body 12 and forms a plate 24 which extends substantially across the diameter of the projectile.

Figure 3:
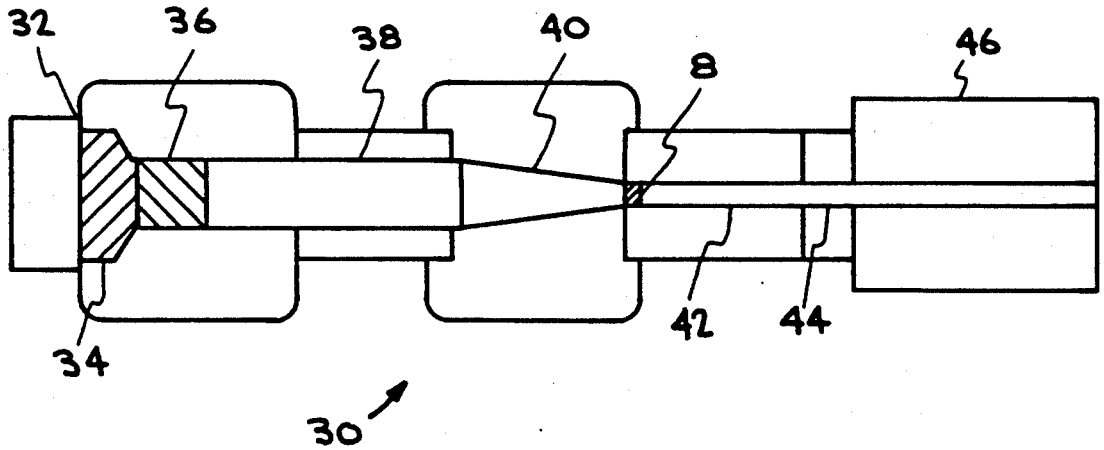
FIG. 3 is a cross-sectional view of a gas gun which utilizes the preferred embodiment of the invention.

FIG. 3 is a cross-sectional view of a two stage light-gas gun 30 which propels the above described preferred embodiment of the invention. The two stage light-gas gun 30 has a first end 32 which holds a propellant 34. Adjacent to the propellant 34 is a piston 36, which is located in a pump tube 38 filled with hydrogen gas. At the end of the pump tube 38 away from the piston 36 the pump tube 38 decreases in cross-sectional area forming an acceleration reservoir 40. The end of the acceleration reservoir 40 is sealed by a diaphragm (not shown) with the projectile 8 placed adjacent to the diaphragm in a launch tube 42. At the end of the launch tube 42 is placed a transition tube 44, and at the end of a transition tube 44 is placed the railgun barrel 46.

In operation the propellant 34 is ignited so that it pushes the piston 36 along the pump tube 38 towards the accelerator tube 40. The piston 36 compresses and accelerates the hydrogen gas in the pump tube 38 and the accelerator tube 40. When the hydrogen gas is sufficiently compressed it ruptures the diaphragm and propels the projectile 8 through the launch tube 42 to the transition tube 44 and through the transition tube 44 to the railgun barrel 46. Measurement instruments are placed in the transition tube 44 to measure the velocity at which the projectile 8 enters the railgun barrel 46 and other parameters.

Figure 4:
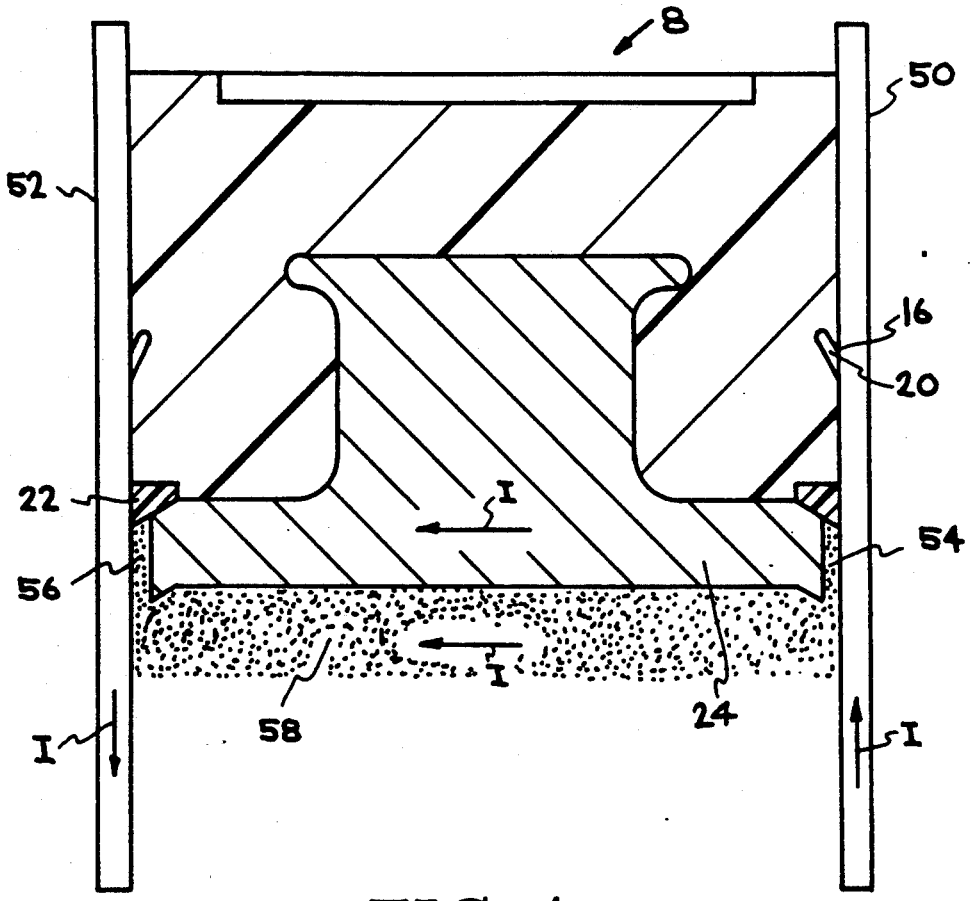
FIG. 4 is a cross-sectional view of the preferred embodiment of the invention between two rails of a railgun.

FIG. 4 is a cross-sectional view of the projectile 8 in a railgun between a first rail 50 and a second rail 52 The direction of flow of the electric current is indicated by labeled arrows. When the projectile 8 enters the railgun barrel (or bore) 46 the aluminum plate 24 may initially make a solid contact with the rails in the railgun acting as a solid armature. Soon gaps 54 and 56 develop between the aluminum plate 24 and the rails 50,52. While the gaps 54,56 develop, the seed blocks 22 begin to wear away depositing silver particles in the gap between the rails and the aluminum plate 24. The silver particles seed a plasma which develops in the gap 54,56 between the rails and the aluminum plate 24 establishing a hybrid armature. The plasma brushes of the hybrid armature are indicated by the shading in the gaps 54,56. The railgun circuit is operated so as to induce a current through the aluminum plate 24 which is high enough to continuously vaporize the aluminum plate and low enough to keep the plate 24 from exploding or completely vaporizing before the projectile 8 reaches the end of the railgun barrel 46. The hydrogen from the gas gun and the vaporizing aluminum are used to establish a plasma armature 58 behind the projectile 8. The continuously vaporizing aluminum replenishes the plasma armature, which reduces ablation of the rails.

The seed blocks 22 are located on the outer surface of the projectile so that they will be in the region of the rails 50,52 They are located just in front of the plate 24, so that they maintain the plasma brushes. Locating the seed blocks 24 at other locations could cause undesirable plasmas and arching.

In an example of the Preferred embodiment of the invention, projectiles 8 with a diameters of 0.5 inches and a lengths of approximately 0.4 inches were fired by a gas gun so that the velocities at which the projectiles 8 entered the breech of the railgun were in the range within approximately 5 km/s to 7 km/s. A small capacitor of 830 μf charged to about 1.5 kV is used to begin current flow through the aluminum plate 24 near the breech of the railgun. In a first trial with an aluminum armature 0.66 mm thick the projectile in the railgun increased in velocity 0.4 km/s over the velocity of the projectile when it entered the railgun. In a second trial with a thicker aluminum armature of 1.52 mm, the projectile in the railgun increased in velocity 1.35 km/s over the velocity of the projectile when it entered the railgun. Although the projectile in the second trial had a larger armature and thus under the prior art should have been less efficient due to extra parasitic mass, the projectile in the second trial had a higher gain in velocity since the projectile in the second trial had a sufficiently thick armature to allow the continuous replenishment of the plasma. In addition, both trials had seed blocks to provide conductive plasma brushes for hybrid operation. In the examples, the ridge 16 maintained sufficient contact with the rails 50 and 52 so that the ridge 16 and the groove 20 significantly reduced blowby.

Figure 5:
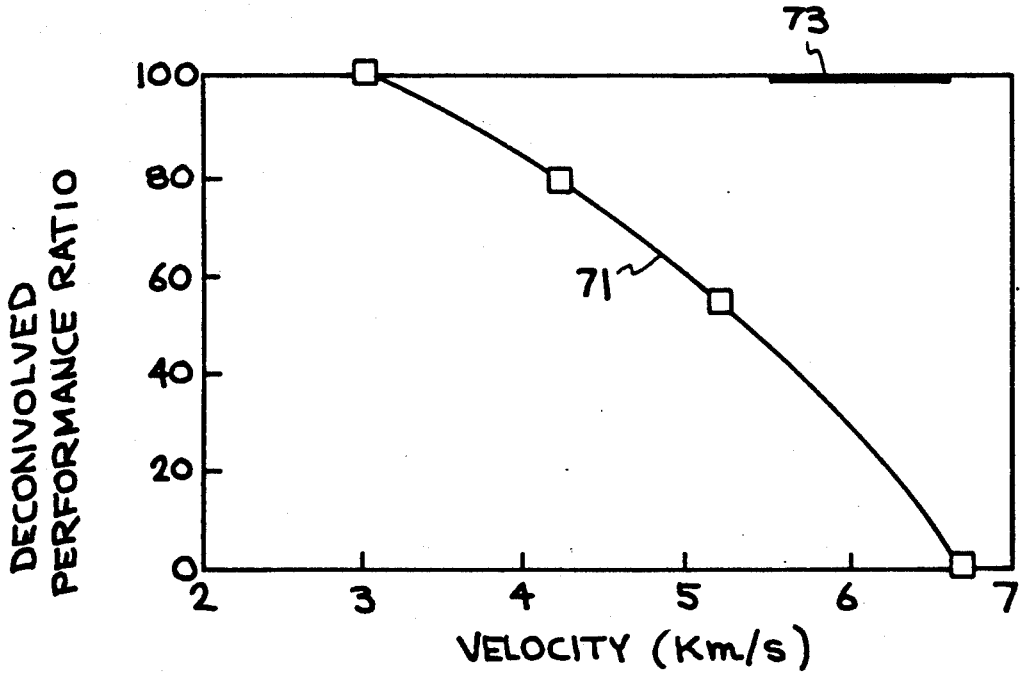
FIG. 5 is a graph of the deconvolved performance ratios of experiments comparing the inventive hybrid/-plasma tandem armatures and prior art plasma armatures.

FIG. 5 illustrates the deconvolved performance ratio of experiments comparing the inventive hybrid/plasma tandem armatures and the prior art plasma armatures. The ordinate indicates the percentage performance ratio, which is the experimentally measured velocity increase obtained divided by the theoretical obtainable velocity increase. The abscissa indicates the injection velocity. The first curve 71 indicates the performance ratio of a pure plasma armature used in the prior art versus velocity. As illustrated in FIG. 5, the performance ratio of the pure plasma armature is approximately 100% at 3 km/s, but as the velocity approaches 7 km/s the performance ratio approaches zero. The second curve 73 indicates the performance ratio of the inventive hybrid/plasma armature. As illustrated, the performance ratio of the hybrid/plasma armature is about, and maintains an approximately constant value as the injection velocity approaches 7 km/s.

The solid armature could be made of other conducting materials such as copper, magnesium, lithium, beryllium, or alloys. In addition to having the armature be part of a core, the armature plate could be attached by a screw or other means to the rest of the projectile. The solid armature may have various shapes, as long as it extends substantially from the first rail 50 to the second rail 52.

The seed blocks 22 could be made of many materials. One requirement of the seed blocks 22 is that the material must wear along with the body of the projectile and that it have some sort of conductive material embedded or be made of a conductive material. The seed blocks 22 could be made of plastic or epoxy with conductive particles of copper, magnesium or aluminum embedded. Seed blocks could also be made of a solid piece of conductive carbon in the form of graphite. For the seed blocks 22 to wear along with the body of the projectile the seed block would need to be as erosive as the body of the projectile, which means the seed blocks will erode away at least as fast as the body of the projectile. It is desirable that the seed blocks are more erosive than the solid armature. The seed blocks 22 could have a variety of shapes. Some of the important aspects of the shape and location of the seed blocks 22 are that they are located and shaped to provide contact with the rails. In addition, by placing the seed blocks 22 near and in front of the armature, the brush plasmas are seeded. Also, the size of the seed blocks is limited, so that only the region around the armature is seeded. Unwanted plasmas and arching are reduced by limiting the seeding to only the armature area.

The blowby baffles can have a variety of shapes. Necessary aspects are a ridge 16 extending as far as or slightly beyond the diameter of the rest of the projectile which would cause the ridge 16 to extend at least as far as the diameter of the barrel, the tip of the ridge 16 forms an angle that is less than 45° to allow the ridge 16 to more easily bend, and that the groove 20 be angled in a forward direction so that plasma which passes between the rail and the armature and seed ring in the forward direction will become caught in the groove 20 creating a radially outward pressure against the tip of the ridge 16 thereby improving the seal.

If the projectile is introduced into the railgun at a velocity of less than approximately 2 km/s, it would be preferable to use a solid contact armature. When the projectile reaches a velocity of approximately 2 km/s, the armature becomes a hybrid armature. As the projectile reaches higher velocities beyond 4 km/s the metal plate begins to vaporize forming a tandem plasma/hybrid armature. In the preferred embodiment of the invention, the tandem hybrid/plasma armature continuously vaporizes as the projectile travels at least half a meter. It is preferred that the vaporization of the metal plate occurs during the entire acceleration of the projectile beyond velocities of 4 km/s.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A projectile for accelerating in a forward direction in a bore of a railgun, said projectile including a transitioning armature and comprising:

a body with an outer surface and a front end and a back end;

an electrically conductive material forming a transitioning armature at the back end of the body; and means for providing a seeding material between the conductive material forming said transitioning armature and the bore of the railgun for establishing a plasma when said armature transitions from a solid armature of a first diameter to a hybrid armature of a lesser diameter and wherein said means is attached to the outer surface of the body and located forward of said transitioning armature.

2. A projectile as claimed in claim 1, wherein the means for providing a seeding material comprises at least one seed block located on the outer surface of the body at a backward end of the body in the region adjacent to the rails and in front of the electrically conductive material forming said armature, and wherein the outer surface of the body is made of an electrically insulative material.

3. A projectile as claimed in claim 2, wherein the seed block is made of a plastic with metal particles embedded within.

4. A projectile as claimed in claim 2, wherein the seed block is made of a material which is more erosive than the electrically conductive material forming the armature, with electrically conductive particles embedded within.

5. A projectile as claimed in claim 2, wherein the seed block is made of a conductive material which is more erosive than the electrical conductive material forming the armature.

6. A projectile as claimed in claim 2, further comprising a ridge formed by the outer surface of the body, wherein the diameter of the ridge is greater than the diameter of any other outer surface of the body, and wherein the ridge forms an acute angle, and a forwardly angled groove adjacent to the ridge.

7. A projectile as claimed in claim 2 wherein the electrically conductive material is of a sufficient thickness to provide continuous vaporization as the projectile travels a distance greater than half a meter.

8. A projectile for acceleration in a forward direction in a bore of railgun, comprising:

a body with an outer surface and a front end and a back end;

means for providing a continuously vaporizing solid armature which transitions from a first cross-section to a lesser cross-section; and means attached to said body forward of said solid armature for providing seeding material as said solid armature vaporizes.

9. A projectile as claimed in claim 8, wherein the means for providing a continuously vaporizing armature comprises a solid electrical conductor located on the back end of the body with a thickness large enough to prevent a current provided by the railgun from exploding the solid electrical conductor.

10. A projectile as claimed in claim 9, wherein the solid electrical conductor is a metal or alloy from the following group of aluminum, magnesium, lithium, or copper.

11. A projectile as claimed in claim 9, wherein the continuously vaporizing armature provides a tandem hybrid/plasma armature.

12. A projectile as claimed in claim 11, wherein said means for providing a seeding material provides seeding material between the solid conductor and the railgun for establishing the hybrid armature.

13. A projectile as claimed in claim 12, further comprising means for reducing blowby.

14. A projectile as claimed in claim 13, wherein the means for reducing blowby, comprises a ridge formed by the outer surface of the body wherein the diameter of the ridge is greater than the diameter of any other outer surface of the body and wherein the ridge forms an acute angle, and a forwardly angled groove adjacent to the ridge.

15. A projectile as claimed in claim 13, wherein the means for providing a seeding material comprises at least one seed block located on the outer surface of the body at the backward end of the body in the region adjacent to the rails and in front of the electrically conductive material forming an armature and wherein the outer surface of the body is made of an electrically insulative material.

16. A method for accelerating a projectile in a forward direction, comprising the steps of:

introducing a projectile between two rails of a railgun, the projectile having a solid electric conductor at a back end thereof;

conducting a current from a first rail of the railgun through the solid electrical conductor located at the back of the projectile to the second rail of the railgun, wherein the current is high enough to continuously vaporize the solid electrical conductor from a first cross-section to a lesser cross-section to replenish a plasma and yet is low enough to prevent the solid conductor from exploding; and maintaining a hybrid plasma brush by providing conductive particles from a material located in front of the solid conductor to a region between the solid conductor and the rails.

17. A method for acceleration as claimed in claim 16, further comprising the step of reducing the amount of plasma passing the projectile in the forward direction.

18. A method for acceleration as claimed in claim 17, wherein the solid electrical conductor is continuously vaporized as the projectile travels at least half a meter.

19. A method as claimed in claim 18, wherein the conductive particles are supplied only to the area between the solid electrical conductor and the rails.

20. A projectile for accelerating in a forward direction in a bore of a railgun, comprising:

a body with an outer surface and a front end and a back end;

an electrically conductive material forming an armature at the back end of the body;

means for providing a seeding material between the conductive material forming an armature and the bore of the railgun for establishing a plasma for a hybrid armature, wherein the means is attached to the outer surface of the body;

wherein the means for providing a seeding material comprises at least one seed block located on the outer surface of the body at the backward end of the body in the region adjacent to the rails and in front of the electrically conductive material forming an armature;

wherein the outer surface of the body is made of an electrically insulative material, and wherein the seed block is made of a plastic with metal particles embedded within.

21. The projectile of claim 20, wherein said seed block is at least as erosive as said body and more erosive than said armature.

22. The projectile of claim 20, wherein each seed block is located on said body and shaped so as to provide contact with an associated rail of the railgun, and sized so that only a region about the armature is seeded.

23. The projectile of claim 20, additionally including means for reducing blowby of plasma.

24. The projectile of claim 23, wherein said means for reducing blowby of plasma includes a ridge formed on the outer surface of said body and a groove formed in the outer surface of said body and located adjacent said ridge.

25. The projectile of claim 20, wherein said armature is of a sufficient thickness to provide continuous vaporization during the entire acceleration of the projectile.

26. A projectile for use in a two stage acceleration system composed of an initial gas acceleration section and a final railgun acceleration section, said projectile utilizing a transitioning armature arrangement and comprising:

a body constructed of an electrically insulative material;

an armature constructed of electrically conductive material and secured to one end of said body and transitions from a first diameter to a lesser diameter;

means for providing a seeding material secured to said body adjacent said one end thereof and located forward of said armature; and means on said outer surface of said body for reducing blowby of a plasma used for accelerating said projectile.

27. The projectile of claim 26, wherein said armature is constructed of material selected from the group consisting of aluminum, copper, magnesium, lithium, beryllium, and alloys thereof.

28. The projectile of claim 26, wherein said means for providing seeding material is made of electrically conductive particles selected from the group of silver, copper, magnesium, and aluminum embedded in material selected from the group of plastic and epoxy.

29. The projectile of claim 26, wherein said means for providing seeding material is made of conductive carbon in the form of graphite.

30. The projectile of claim 26, wherein said means for providing seeding material is made of material which is as erosive as the material of said body and more erosive than the material of said armature, and is located and shaped so as to initially contact rails of an associated railgun and limit seeding only in region about said armature.

31. The projectile of claim 26, wherein said means for reducing blowby is located forward on said projectile body from said means for providing seeding and comprises a ridge formed about an outer surface of said body and a groove formed in said body adjacent said ridge.

32. The projectile of claim 31, wherein said ridge extends from said body at an angle and said groove extends at an angle from said outer surface of said body.

33. The projectile of claim 26, wherein, said body is provided with a cavity therein which is open at said one end of said body;

said armature includes a first central section which extends into said cavity of said body, and a second section which extends outwardly from said central section along said one end of said body and terminates at an outer surface of said body; and said means for providing seeding material comprises a plurality of seed blocks located in spaced relationship with each other, each seed block being located intermediate an outer section of said body and an outer section of said second section of said armature.

34. The projectile of claim 33, wherein said outer surface of said body adjacent said one end thereof, an outer surface of each of said plurality of seed blocks, and an outer surface of said second section of said armature initially form a substantially continuous outer surface.

35. The projectile of claim 34, wherein said means for reducing blowby is located on said outer surface of said body forward from said means for providing seeding material, and comprises:

a ridge which extends around said outer surface of said body and outwardly therefrom at an angle that is less than 45°; and a groove formed in and around said outer surface of said body adjacent said ridge and intermediate said ridge and said means for providing seeding material, said groove being angled in a forward direction;

whereby plasma generated to accelerate the projectile through an associated railgun is substantially prevented from passing forward along said outer surface of said body.

* * * * *